US012545547B2

(12) United States Patent
Kim et al.

(10) Patent No.: US 12,545,547 B2
(45) Date of Patent: Feb. 10, 2026

(54) APPARATUS FOR MOVING A MEMBER

(71) Applicant: Endo Robotics Co., Ltd., Seoul (KR)

(72) Inventors: Byung Gon Kim, Seoul (KR); Kyung nam Kim, Seoul (KR); Ye Chan Seo, Seoul (KR)

(73) Assignee: Endo Robotics Co., Ltd., Seoul (KR)

( * ) Notice: Subject to any disclaimer, the term of this patent is extended or adjusted under 35 U.S.C. 154(b) by 267 days.

(21) Appl. No.: 18/186,075

(22) Filed: Mar. 17, 2023

(65) Prior Publication Data

US 2023/0294954 A1 Sep. 21, 2023

(30) Foreign Application Priority Data

Mar. 18, 2022 (KR) ..... 10-2022-0034303

(51) Int. Cl.
*B65H 51/08* (2006.01)

(52) U.S. Cl.
CPC ..... *B65H 51/08* (2013.01); *B65H 2513/41* (2013.01); *B65H 2701/39* (2013.01)

(58) Field of Classification Search
CPC . B65H 51/08; B65H 2513/14; B65H 2701/39
USPC ..... 226/24
See application file for complete search history.

(56) References Cited

U.S. PATENT DOCUMENTS 11,896,330 B2 * 2/2024 Castillo ..... A61B 34/37
2004/0079780 A1 * 4/2004 Kato ..... B21C 47/18 226/24
2011/0015648 A1 1/2011 Alvarez et al.
2014/0277333 A1 9/2014 Lewis et al.
2015/0173838 A1 * 6/2015 Murphy ..... A61B 34/30 606/130
2023/0294954 A1 * 9/2023 Kim ..... A61B 34/30 226/24

FOREIGN PATENT DOCUMENTS

CN 112278989 A * 1/2021 ..... B65H 51/08
CN 113633383 A 11/2021
CN 215780871 U 2/2022
(Continued)

OTHER PUBLICATIONS

European Search Report dated Aug. 2, 2023 in European Application No. 23162750.6.

(Continued)

*Primary Examiner* — Rakesh Kumar
(74) *Attorney, Agent, or Firm* — Knobbe, Martens, Olson & Bear, LLP

(57) ABSTRACT

Disclosed is a moving device. A moving device for moving a tubular member according to an aspect of the present disclosure may include a housing through which the tubular member passes, a first roller and a second roller arranged to face both sides of the tubular member inside the housing and having outer circumferential surfaces that presses the tubular member, an actuator that provides a driving force for rotating the first roller, a sensor that measures a movement amount of the tubular member, and a controller that controls the actuator on the basis of the movement amount of the tubular member, wherein, when the first roller rotates, the tubular member between the first roller and the second roller moves by a frictional force.

17 Claims, 16 Drawing Sheets

(56) References Cited

FOREIGN PATENT DOCUMENTS

| | | | | | |
|---|---|---|---|---|---|
| EP | 1987788 | A1 * | 11/2008 | ..... | A61B 1/00147 |
| EP | 1987788 | B1 | 7/2016 | | |
| JP | 2003-048194 | A | 2/2003 | | |
| JP | 2005-073760 | A | 3/2005 | | |
| JP | 2006-0141976 | A | 6/2006 | | |
| JP | 2007-136082 | A | 6/2007 | | |
| JP | 2008-000579 | A | 1/2008 | | |
| JP | 2009-055956 | A | 3/2009 | | |
| JP | 2014-227277 | A | 12/2014 | | |
| WO | WO-2013043872 | A1 * | 3/2013 | ..... | A61B 34/30 |
| WO | WO-2021028889 | A1 * | 2/2021 | ..... | A61B 34/20 |

OTHER PUBLICATIONS

Office Action in Japanese Patent Application No. 2023-044641 issued on Feb. 13, 2024.

* cited by examiner

APPARATUS FOR MOVING A MEMBER

CROSS-REFERENCE TO RELATED APPLICATION

This application claims priority to and the benefit of Korean Patent Application No. 10-2022-0034303 filed on Mar. 18, 2022, the disclosure of which is incorporated herein by reference in its entirety.

BACKGROUND

Field

The present disclosure relates to a moving device, and more particularly, to a moving device that can move a tubular member.

Discussion of Related Art

Endoscopes are instruments designed to observe bodies by inserting machines into the bodies to identify lesions in organs, which cannot be directly observed without surgery or autopsy. In recent years, various types of surgical instruments for performing a procedure of an inside of an organ without cutting the body of a patient have been devised.

A portion of the endoscopic instrument, inserted into a human body, is generally a tubular member due to structural characteristics of the human body and for minimization of a surgical site. For example, devices for performing surgery by attaching a surgical instrument to the endoscope and inserting the surgical instrument into the body of the patient have been developed.

In addition, the tubular member is widely used for convenience and efficiency of insertion and extraction even in an endoscopic instrument for identifying an inside of a structure or inspecting an inside of a pipe.

When the tubular member is manually inserted, a considerable time is taken for inserting and extracting the tubular member during work or a procedure, and considering characteristics of a work environment in which the insertion and the extraction should be repeatedly performed, a user feels a considerable physical burden. Further, since the user directly moves the tubular member, it is difficult to accurately measure and control the amount of movement of the tubular member.

The disclosure of this section is to provide background information relating to the present disclosure. Applicant does not admit that any information contained in this section constitutes prior art.

SUMMARY

In view of the foregoing, development of a moving device which can automatically move the tubular member and accurately control the amount of movement of the tubular member has been acutely required.

The present disclosure is directed to providing a moving device which may automatically move a tubular member.

The present disclosure is directed to also providing a moving device which may accurately control a movement amount of the tubular member.

The present disclosure is directed to also providing a moving device in which an operation unit, a driving unit, and an operation control unit may be separated from each other.

The present disclosure is directed to also providing a moving device which may be easily switched from an automatic mode in which the tubular member may be automatically inserted or extracted to a manual mode in which a user directly inserts or extracts the tubular member or may be easily switched from the manual mode to the automatic mode.

The aspects the present disclosure are not limited to the aspects described above, and those skilled in the art to which the present disclosure pertains will clearly understand other aspects not described from the following description.

According to an aspect of the present disclosure, there is provided a moving device for moving a tubular member, the moving device including a housing through which the tubular member passes, a first roller and a second roller arranged to face both sides of the tubular member inside the housing and having outer circumferential surfaces that press the tubular member, an actuator that provides a driving force for rotating the first roller, a sensor that measures a movement amount of the tubular member, and a controller that controls the actuator on the basis of the movement amount of the tubular member, wherein, when the first roller rotates, the tubular member between the first roller and the second roller moves by a frictional force.

The sensor may include a first sensor that detects a position of the first roller, and the controller may measure the movement amount of the tubular member using the position of the first roller.

The actuator may include a motor, the first sensor may be a first encoder provided in a rotary shaft of the motor, and the controller may measure the movement amount of the tubular member using a position of the rotary shaft, which is detected by the first encoder.

The sensor may include a second sensor that detects a position of the second roller, and the controller may measure the movement amount of the tubular member using the position of the second roller.

A magnetic body rotating together with the second roller may be provided on one side of the second roller, the sensor may include a second encoder positioned adjacent to the magnetic body to detect a position of the magnetic body, and the controller may measure the movement amount of the tubular member using the position of the magnetic body.

The sensor may include a first sensor that detects a position of the first roller, and a second sensor that detects a position of the second roller, and the controller may control the actuator on the basis of a first movement amount of the tubular member, which is measured using the position of the first roller, and a second movement amount of the tubular member, which is measured using the position of the second roller.

The housing may include a first hosing in which the first roller and the second roller are embedded, and a second housing in which the actuator is embedded, and the first housing and the second housing may be detachably coupled to each other.

The controller and the sensor may be provided in the second housing.

The moving device may further include a roller operation unit provided in the housing to move the second roller toward the first roller, wherein, when the first roller rotates at a first position in which the second roller is adjacent to the first roller, the tubular member is moved by the frictional force.

The roller operation unit may include an operation member provided to be movable relative to the housing and having one side coupled to a rotary shaft of the second roller, and a driving member that moves the operation member, and as the operation member moves by the driving member, the second roller may move to the first position from a second position in which the second roller is farther away from the first roller than the first position.

The driving member may include a button member that is pressed into the housing, and as the button member is pressed, the operation member may move.

A hole through which the tubular member passes may be formed in the housing, and the roller operation unit may include a shutter member that is positioned adjacent to the hole and opens or closes the hole of the housing.

The shutter member may have one side coupled to the operation member to be movable integrally with the operation member, the shutter member may open the hole of the housing in a state in in which the operation member moves the second roller to the first position, and the shutter member may close at least a portion of the hole of the housing in a state in which the operation member moves the second roller to the second position.

A first gear that receives the driving force from the actuator to rotate integrally with the first roller may be provided on one side of the first roller, and a second gear that rotates integrally with the second roller and is engaged with the first gear may be provided on one side of the second roller.

The moving device may further include a power transmission member that transmits the driving force provided from the actuator to the second roller, wherein the power transmission member includes at least two gear members.

Grooves corresponding to an outer circumference of the tubular member may be formed in outer circumferential surfaces of the first roller and the second roller.

The housing may be provided with a guide member that guides movement of the tubular member.

The first roller may be provided as a plurality of first rollers, and the plurality of first rollers may be arranged in a longitudinal direction of the tubular member.

The plurality of first rollers may include a first upper roller and a first lower roller, a belt having an outer portion in contact with an outer circumference of the tubular member may be provided on outer circumferential surface of the first upper roller and the first lower roller, and when the first roller rotates, the tubular member between the belt and the second roller may be moved by the frictional force.

The second roller may be provided as a plurality of second rollers, and the plurality of second rollers may be arranged in a longitudinal direction of the tubular member.

BRIEF DESCRIPTION OF THE DRAWINGS

The above and other features and advantages of the present disclosure will become more apparent to those of ordinary skill in the art by describing embodiments thereof in detail with reference to the accompanying drawings, in which.

DETAILED DESCRIPTION OF EMBODIMENTS

Figure 1:
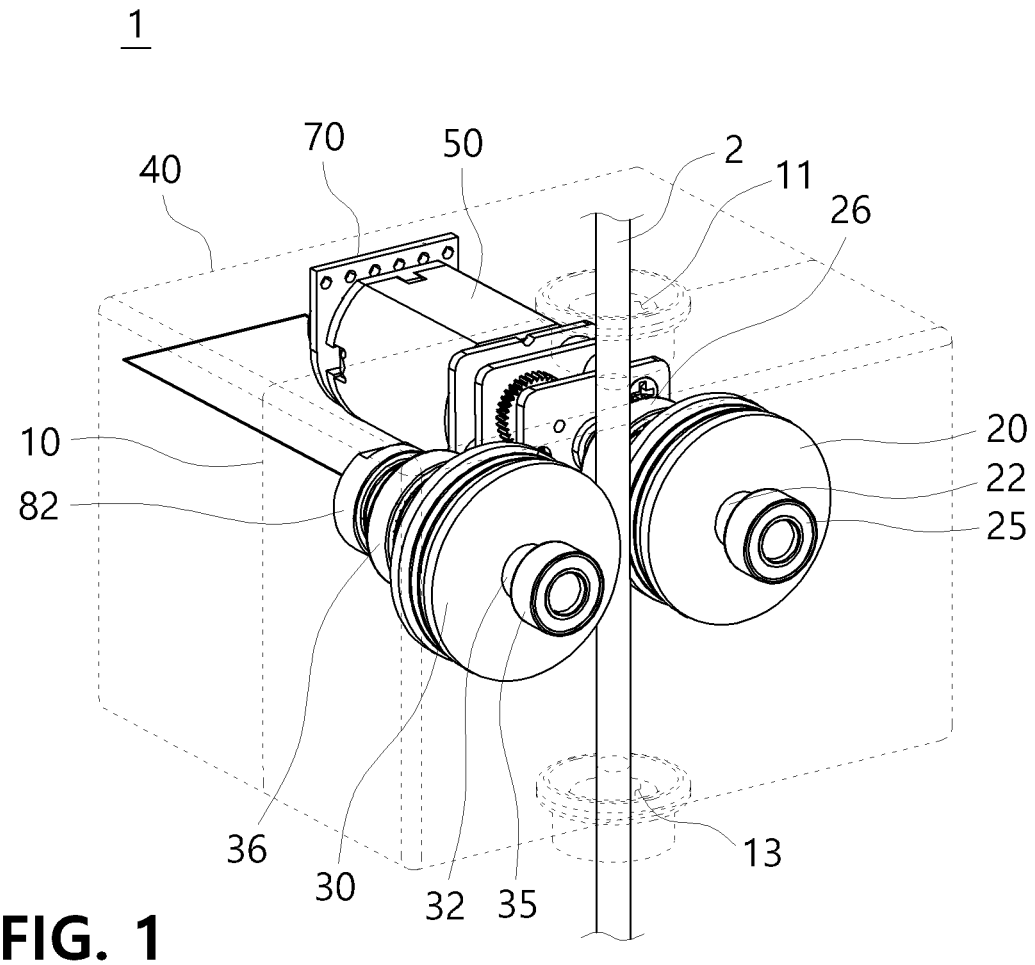
FIGS. 1 and 2 are perspective views illustrating a moving device according to a first embodiment of the present disclosure when viewed from different angles. For description of the present disclosure, first and second housings are indicated by dotted lines, and configurations seen through the first and second housings are indicated by solid lines.

Hereinafter, embodiments of the present disclosure will be described in detail with reference to the accompanying drawings so that those skilled in the art to which the present disclosure pertains may easily implement the present disclosure. The present disclosure may be implemented in various different forms and is not limited to the embodiments described herein. In the drawings, parts irrelevant to the description are omitted in order to clearly describe the present disclosure, and the same reference numerals are assigned to the same or similar components throughout the specification.

Terms or words used in the present specification and the appended claims are not limitedly interpreted as usual or dictionary meanings and should be interpreted as meanings and concepts corresponding to the technical spirit of the present disclosure based on the principle that the inventor may appropriately define the concepts of the terms in order to describe the inventor's disclosure in the best way.

It should be understood in the present specification that the terms "include" or "have" are intended to describe that there are features, numbers, steps, operations, components, parts, or combinations thereof that are described in the specification and do not exclude in advance the possibility of the presence or addition of one or more other features, numbers, steps, operations, components, parts, or combinations thereof.

A case in which a component is present on a "front side," a "rear side," an "upper side," or a "lower side" of another component includes a case in which the component is disposed on the "front side," the "rear side," the "upper side," or the "lower side" in direct contact with the another component as well as a case in which still another component is disposed therebetween, unless otherwise specified. Further, a case in which a first component is "connected" to a second component includes a case in which the first component and the second component are indirectly connected to each other as well as a case in which the first component and the second component are directly connected to each other unless otherwise specified.

An embodiment of the present disclosure relates to a moving device for moving a tubular member, in which outer circumferential surfaces of first and second rollers that may press both sides of an outer circumference of the tubular member press both sides of the outer circumference of the tubular member, the first roller receives a driving force by an actuator, and thus the tubular member may move by a frictional force between the outer circumference of the tubular member and the outer circumferential surfaces of the first and second rollers. In this case, in the moving device according to the embodiment of the present disclosure, a sensor and a controller may measure the movement amount of the tubular member, and the controller may control an actuator on the basis of the measured movement amount, thereby accurately controlling the movement amount of the tubular member.

Meanwhile, the tubular member may mean an elongated member having a diameter of, for example, several mm to several cm. A diameter of the tubular member that may be moved by the moving device may be variously selected according to the size of a component of the moving device. As an example, the tubular member may be a portion of an endoscope or a portion of a surgical tool or device used with the endoscope. However, the moving device for moving the tubular member according to the embodiment of the present disclosure is not limited to moving a portion of the endoscope or a portion of an endoscope instrument.

Figure 2:
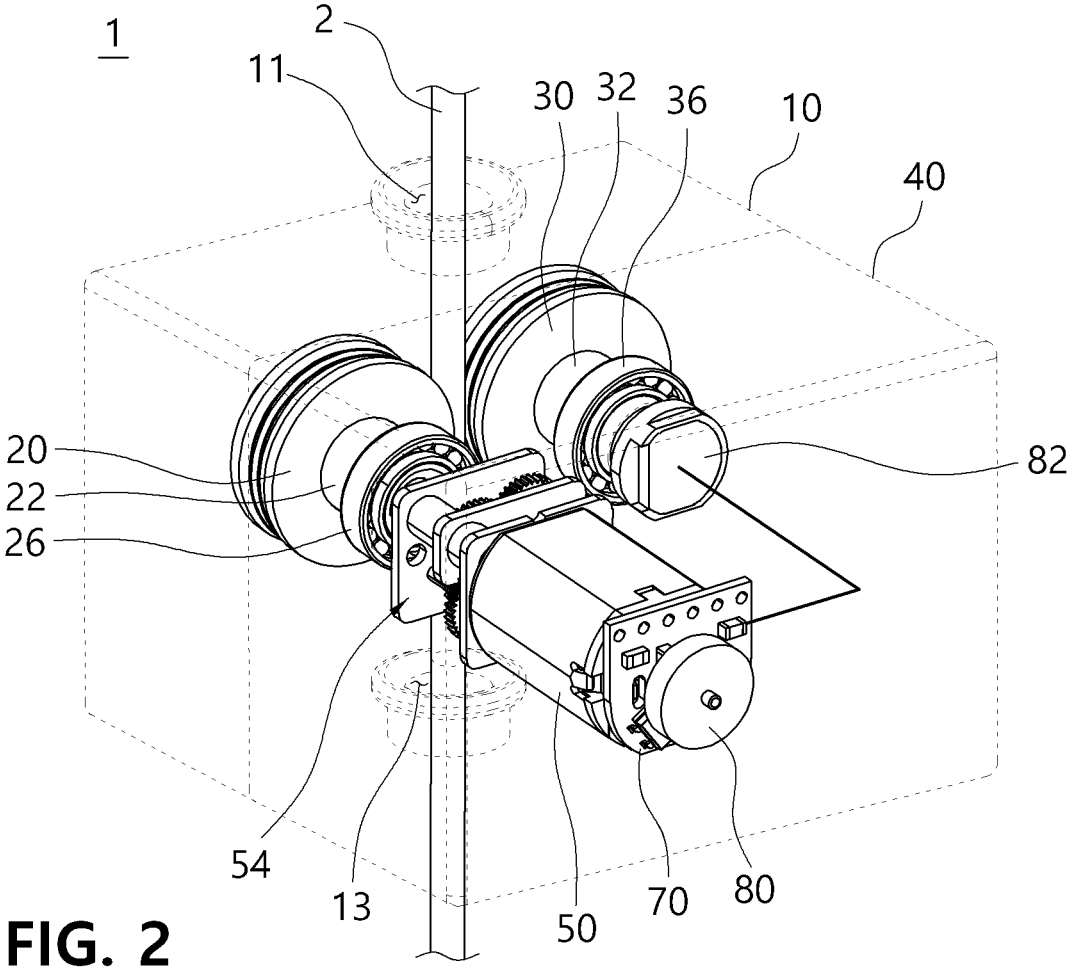
Figure 3:
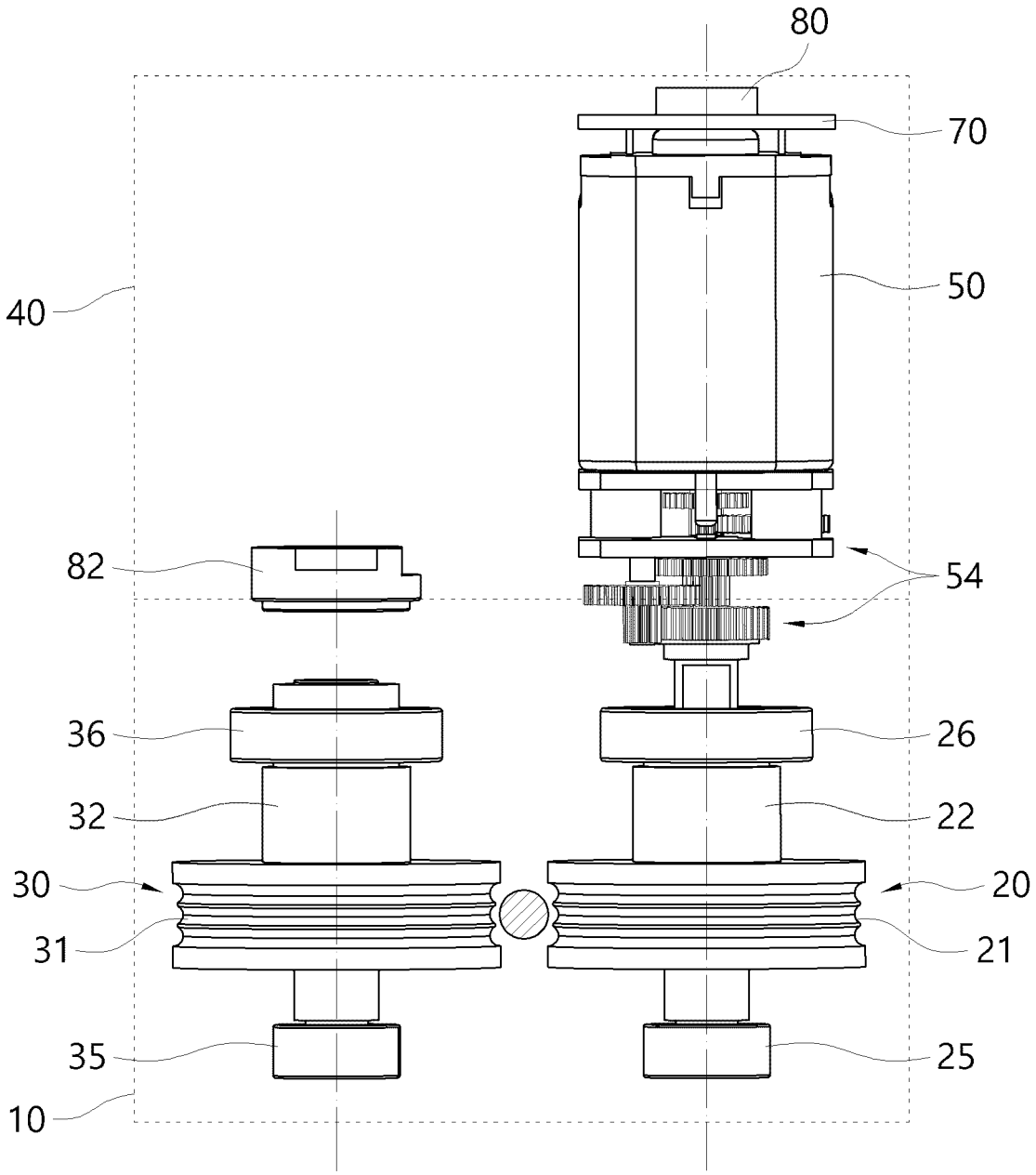
FIG. 3 is a plan view of the moving device according to the first embodiment of the present disclosure. For description of the present disclosure, first and second housings are indicated by dotted lines, and configurations seen through the first and second housings are indicated by solid lines.
Figure 4:
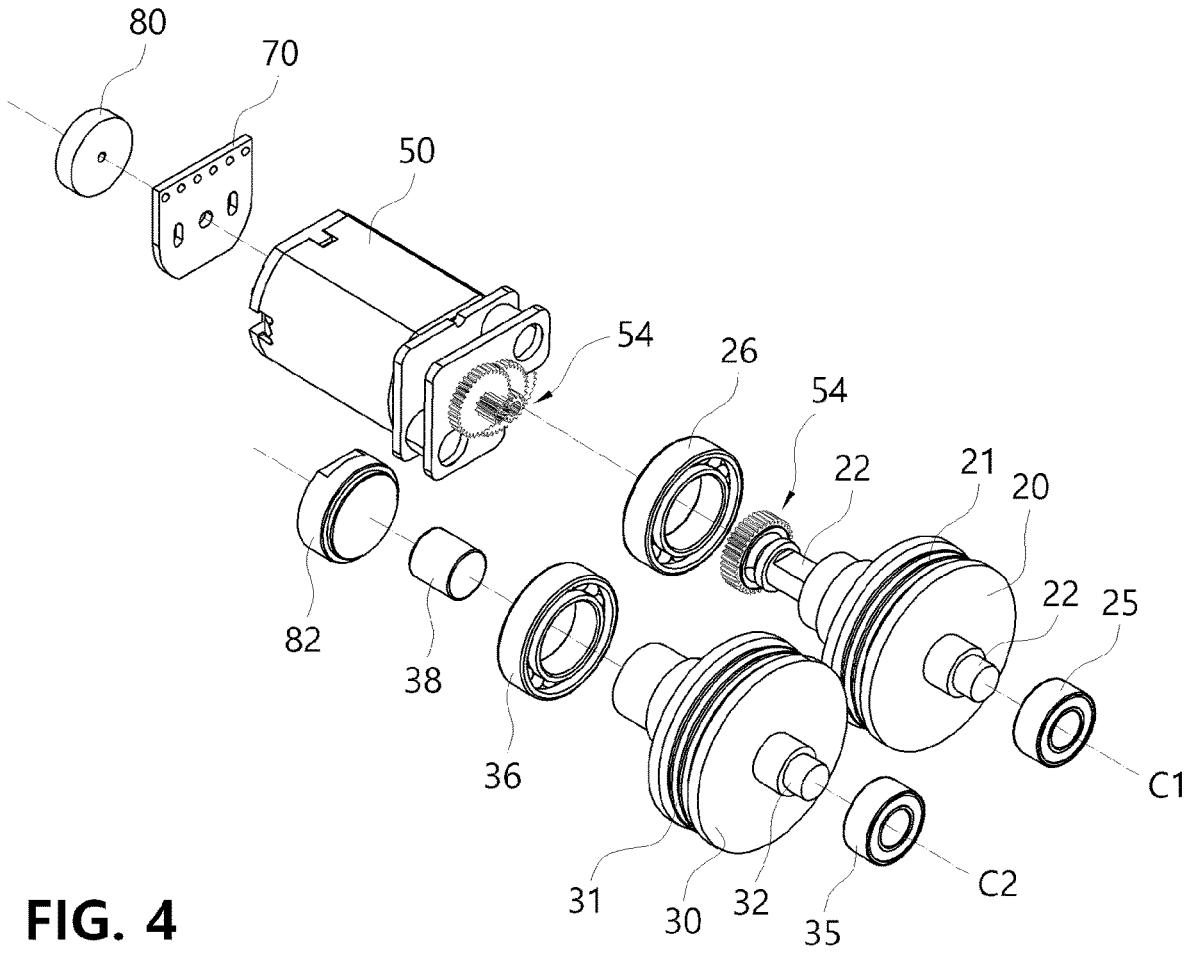
FIGS. 4 and 5 are exploded perspective views of first and second rollers, first and second sensors, an actuator, and a controller of the moving device according to the first embodiment of the present disclosure when viewed from different angles.
Figure 5:
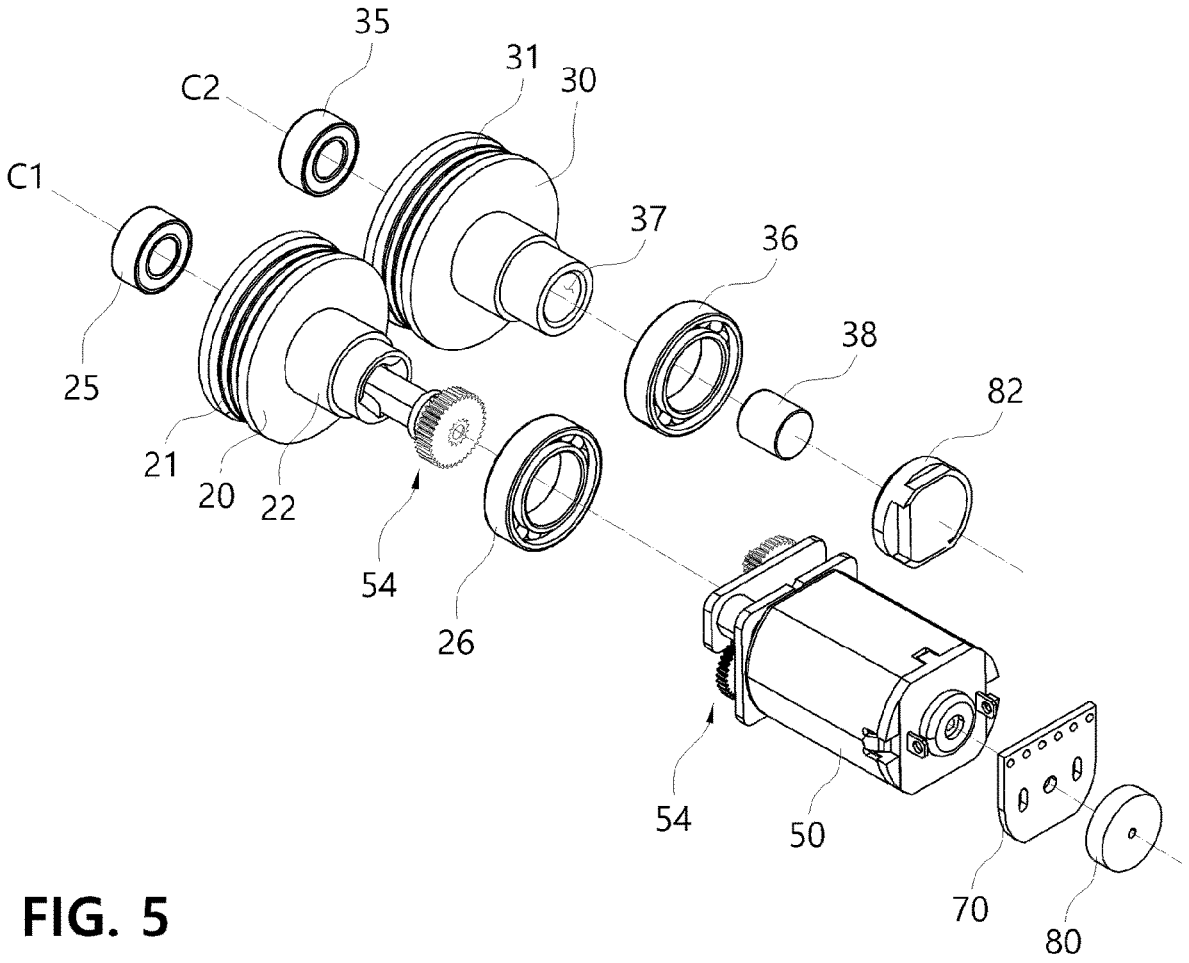
Figure 6:
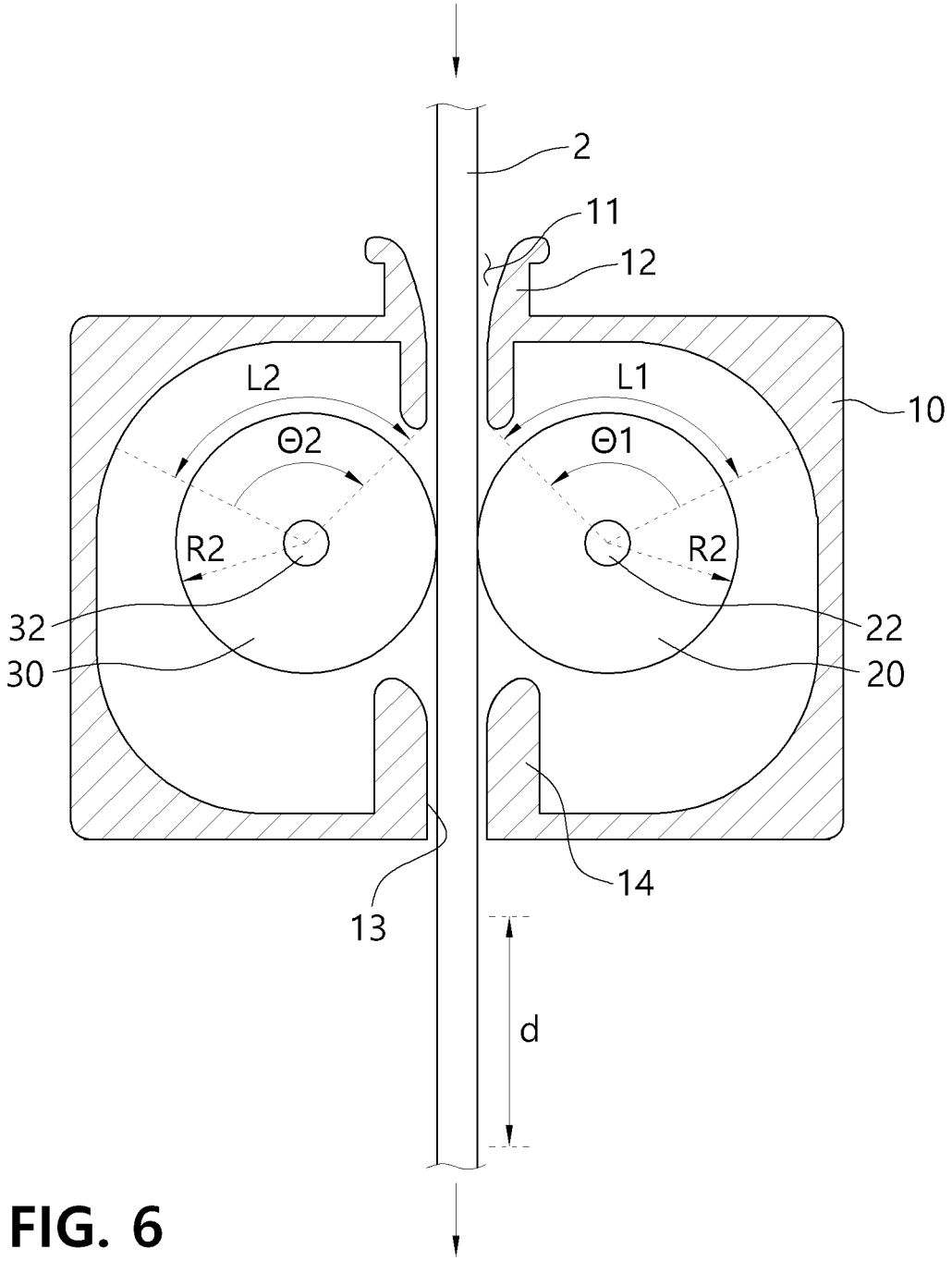
FIG. 6 is a cross-sectional view of the moving device according to the first embodiment of the present disclosure.

FIGS. 1 and 2 are perspective views illustrating a moving device according to a first embodiment of the present disclosure when viewed from different angles. For description of the present disclosure, first and second housings are indicated by dotted lines, and configurations seen through the first and second housings are indicated by solid lines. FIG. 3 is a plan view of the moving device according to the first embodiment of the present disclosure. For description of the present disclosure, first and second housings are indicated by dotted lines, and configurations seen through the first and second housings are indicated by solid lines. FIGS. 4 and 5 are exploded perspective views of first and second rollers, first and second sensors, an actuator, and a controller of the moving device according to the first embodiment of the present disclosure when viewed from different angles. FIG. 6 is a cross-sectional view of the moving device according to the first embodiment of the present disclosure.

In the following description of the drawings, each direction is defined and described based on coordinate axes illustrated in FIG. 1. In more detail, a positive direction of the z axis is defined as an upward direction, and a negative direction of the z axis is defined as a downward direction. A positive direction of the y axis is defined as a rearward direction, and a negative direction of the y axis is defined as a forward direction. A positive direction of the x axis is defined as a leftward direction, and a negative direction of the x axis is defined is a rightward direction.

Referring to FIGS. 1 to 3, a moving device 1 according to a first embodiment of the present disclosure may include a first housing 10, first and second rollers 20 and 30, a second housing 40, an actuator 50, a controller 70, and sensors 80 and 82. In this case, the first and second rollers 20 and 30 are referred to as operation units for moving a tubular member 2, the actuator 50 is referred to as a driving unit for providing a driving force for moving the tubular member 2, and the controller 70 and the sensors 80 and 82 are referred to as operation control units for measuring and controlling the movement amount of the tubular member 2.

In the drawings, components necessary for understanding of the present disclosure are mainly illustrated, and the other components are omitted. In embodiments, the first and second housings 10 and 40 may be additionally provided with other components in which the above components are to be installed.

Referring to FIGS. 1 and 2, in the first embodiment of the present disclosure, the first housing 10 has a box-shaped structure and accommodates and protects the operation units (that is, the first and second rollers 20 and 30) therein. In this case, the first housing 10 may be made of various materials such as metal or a thermosetting resin.

An inlet 11 communicating with an inner space of the first housing 10 is formed on one surface, for example, an upper surface, of the first housing, and an outlet connected to the outside in the inner space of the first housing 10 is formed on a lower surface opposite to the upper surface. In this case, the inlet 11 and the outlet 13 are coaxially arranged to correspond to each other.

The tubular member 2 may be inserted into the first housing 10 or extracted to the outside through the inlet 11 and the outlet 13 of the first housing 10. To this end, a diameter of the inlet 11 and the outlet 13 is formed to be greater than a diameter of the tubular member 2. In this case, the diameter of the inlet 11 and the outlet 13 may have a sufficient size so that guide members 12 and 14 (illustrated in FIG. 6), which will be described, may be installed.

Referring to FIG. 6, in the first embodiment of the present disclosure, the first guide member 12 and the second guide member 14 may be provided in the inlet 11 and the outlet 13 of the first housing 10, respectively.

The first guide member 12 is fixedly installed in the inlet 11 of the first housing 10. In this case, a first guide hole having a fallopian tube shape of which a diameter increases from the inside to the outside of the first housing 10 is formed at a center of the first guide member 12. Accordingly, the tubular member 2 may be easily inserted from the outside to the inside of the first housing 10 through the first guide hole.

The second guide member 14 is fixedly installed in the outlet 13 of the first housing 10. In this case, a second guide hole having a fallopian tube shape of which a diameter increases from the outside to the inside of the second housing 40 is formed at a center of the second guide member 14. Accordingly, the tubular member 2 inserted into the first housing 10 may be easily extracted to the outside of the first housing 10 through the second guide hole.

Further, the guide members 12 and 14 may guide the movement of the tubular member 2 inside the first housing 10, guide the tubular member 2 to a space between the first and second rollers 20 and 30, and thus prevent the tubular member 2 from being twisted inside the first housing 10.

Referring to FIGS. 3 to 5, first and second rotary shaft members 22 and 32 are arranged inside the first housing 10 along first and second axes C1 and C2 parallel to each other, respectively. The first and second axes C1 and C2 may mean an axis extending in a front-rear direction of the first housing 10.

In this case, according to the first embodiment of the present disclosure, one end of the first rotary shaft member 22 is installed on an inner wall of the first housing 10, and the other end thereof extends rearward through a rear wall of the first housing 10 to be directly or indirectly connected to the actuator 50 positioned outside the first housing 10. A power transmission member 54 that may receive the driving force generated by the actuator 50 is provided at the other end of the first rotary shaft member 22. In the present embodiment, the power transmission member 54 provided at the other end of the first rotary shaft member 22 include a spur gear.

Both ends of the second rotary shaft members 32 are installed on the inner wall of the first housing 10. In this case, a magnetic body groove 37 in which a magnetic body 38 having a magnetic property may be installed is formed at one end of the second rotary shaft member 32, that is, a rear end thereof with respect to FIG. 4. The magnetic body 38 may be fixedly inserted into the magnetic body groove 37 and may rotate integrally with the second rotary shaft member 32. A function of the magnetic body 38 will be described below together with the second sensor 82.

In this case, in the present embodiment, a first bearing member 25 is provided at the one end of the first rotary shaft member 22 and a second bearing member 26 is provided between a portion of the first rotary shaft member 22 passing through the first housing 10 and the rear wall of the first housing 10 so that the first and second rotary shaft members 22 and 23 may rotate smoothly. Likewise, third and fourth bearing members 35 and 36 are provided at both ends of the second rotary shaft member 32. In this case, the first to fourth bearing members 25, 26, 35, and 36 may be ball bearings.

The first and second rollers 20 and 30 having a disc shape are arranged to face both sides of the tubular member 2 passing through the first housing 10. The first and second rollers 20 and 30 are positioned side by side at an appropriate distance so that the tubular member 2 may pass therebetween and the first and second rollers 20 and 30 may press an outer circumference of the tubular member 2.

In this case, the first roller 20 is installed in the first rotary shaft member 22 to rotate integrally with the first rotary shaft member 22, and the second roller 30 is installed in the second rotary shaft member 32 to rotate together with the second rotary shaft member 32.

When the first roller 20 and the first rotary shaft member 22 receive a driving force from the outside to rotate in one direction so as to press the outer circumference of the tubular member 2, the tubular member 2 moves due to a frictional force generated between an outer circumferential surface of the first roller 20 and the tubular member 2.

In this case, the second roller 30 presses an opposite side to the tubular member 2 to function to provide a normal drag force so that a sufficient frictional force may be applied to the tubular member 2. Meanwhile, the second roller 30 also rotates in the one direction due to a frictional force generated between the tubular member 2 and the second roller 30.

In this way, the moving device 1 according to the first embodiment of the present disclosure may move the tubular member 2 using the frictional forces between the rollers 20 and 30 and the tubular member 2.

Meanwhile, referring to FIG. 3, grooves corresponding to the outer circumference of the tubular member 2 are formed in outer circumferential surfaces of the first roller 20 and the second roller 30. Accordingly, since a contact area between the outer circumferential surfaces of the first and second rollers 20 and 30 and the tubular member 2, a greater frictional force may be applied to the tubular member 2.

In the present embodiment, the grooves formed in the outer circumferential surfaces of the first and second rollers 20 and 30 may have a semicircular shape according to the cross-sectional shape of the tubular member 2, but the present disclosure is not limited thereto, and the grooves may have an elliptic shape according to the shape of the tubular member 2.

Furthermore, in order to increase a frictional force between the first and second rollers 20 and 30 and the tubular member 2, frictional members 21 and 31 may be provided on the outer circumferential surfaces of the first and second rollers 20 and 30. In this case, the frictional members 21 and 31 may be provided as a plurality of frictional members.

Further, grooves having a shape similar to that formed in an outer circumferential surface of a vehicle tire may be formed in outer surfaces of the frictional members 21 and 31 to increase a frictional force or a frictional coefficient.

In the present embodiment, the frictional members 21 and 31 may include a plurality of elastic rubber rings, but the shape and material of the frictional members 21 and 31 are not particularly limited as long as the frictional force or the frictional coefficient between the first and second rollers 20 and 30 and the tubular member 2 is secured.

Referring back to FIGS. 1 and 2, the second housing 40 is detachably coupled to one side of the first housing 10, that is, a rear side of the first housing 10 with respect to FIG. 1. The second housing 40 is a box-shaped structure having an inner space and functions to accommodate and protect the driving unit (that is, the actuator 50) and the operation control unit (that is, the controller 70 and the sensors 80 and 82) in the inner space.

In this case, various coupling methods such as a coupling structure by a bolt and a net, a coupling structure by a sliding method, and a coupling structure by a hook and a ring may be applied to a detachable coupling structure between the first and second housings 10 and 40.

In this way, in the moving device 1 according to the first embodiment of the present disclosure, the operation unit, the driving unit, and the operation control unit are separately arranged in the first and second housing 10 and 40 and the first and second housings 10 and 40 are detachably coupled to each other. Thus, since only the first housing 10 may be separately washed, damage to the driving unit and the operation control unit occurring during the washing process of the operation unit can be prevented.

Further, in the moving device 1 according to the first embodiment of the present disclosure, worn, damaged, and defective portions of the operation unit, the driving unit, and the operation control unit can be easily replaced or repaired.

The actuator 50 is a device that provides the driving force for rotating the first rotary shaft member 22 and the first roller 20 and is fixedly installed inside the second housing 40. In the present embodiment, the actuator 50 include an electric motor provided with a motor rotary shaft 52. In this case, a battery for providing energy to the actuator 50 or the like may be provided in the second housing 40.

Referring to FIGS. 3 to 5, the power transmission member 54 is provided between the actuator 50 and the first rotary shaft member 22. The power transmission member 54 includes a plurality of gears that transmit the driving force generated by the actuator 50 to the first rotary shaft member 22 and function to adjust a rotation speed ratio, a rotational direction, and a torque ratio of the motor rotary shaft 52 and the first rotary shaft member 22.

In this case, the power transmission member 54 may include at least two gears. In this case, the at least two gears include a gear provided at one end of the motor rotary shaft 52 and a gear provided at the other end of the first rotary shaft member 22.

In the present embodiment, the power transmission member 54 may include a plurality of spur gears or the power transmission member 54 may include widely known various gears including a worm wheel and a worm shaft to decrease a backlash.

The controller 70 that may control the actuator 50 is provided on one side of the actuator 50. In this case, the controller 70 may be processing devices such as a printed circuit board (PCB) on which an electric circuit is printed, a microprocessor, a general-purpose processor, a central processing unit (CPU), a digital signal processor (DSP), or combinations of these components.

The controller 70 may be electrically connected to the first and second sensors 82, which will be described below, receive information, measure the movement amount of the tubular member 2 on the basis of the received information, and control the actuator 50 using the measured movement amount.

Meanwhile, a manipulation unit may be provided on one side of the first housing 10 or the second housing 40 so that a user can control the movement amounts of the actuator 50 and the tubular member 2. The manipulation unit may be physically or electrically connected to the controller 70 to transmit or receive a signal. In this case, the manipulation unit may include a plurality of buttons or may include a display or the like that may generate a signal in a touch manner.

Referring to FIGS. 1 to 5, the first sensor 80 may be a sensor provided to measure a position, for example, a rotational angle and direction, of the first roller 20 and may be provided on one side of the actuator 50 or the first roller 20. In the present embodiment, the first sensor 80 includes a first encoder provided in the motor rotary shaft 52.

The first sensor 80 measures a rotational angle and direction of the motor rotary shaft 52. The first sensor 80 may measure the rotational angle and direction of the motor rotary shaft 52 and a rotational angle and direction of the first roller 20 may be indirectly measured by considering a gear ratio and a rotational direction change by the power transmission member 54.

The second sensor 82 may be a sensor provided to measure a position, for example, a rotational angle and direction, of the second roller 30 and may be provided on one side of the second roller 30. In the present embodiment, the second sensor 82 includes a second encoder disposed on one side of the second rotary shaft member 32, that is, on a rear side of the second rotary shaft member 32 with respect to FIG. 4. In this case, the second sensor 82 may be installed on a wall surface of the second housing 40 or mounted inside a side wall of the second housing 40.

The second sensor 82 measures a rotational angle and direction of the magnetic body 38 fixed to an end of the second rotary shaft member 32 using magnetic properties. The second sensor 82 may measure the rotational angle and direction of the magnetic body 38 and thus the rotational angle and direction of the second roller 30 may be indirectly measured.

In the present embodiment, the sensors 80 and 82 measure the rotational angles and the rotational directions of the first and second rollers 20 and 30 to indirectly measure the movement amount of the tubular member 2. However, in another embodiment, it is apparent that the sensors 80 and 82 may be provided adjacent to the tubular member 2 to directly measure the movement amount of the tubular member 2. Further, the sensors 80 and 82 may be provided in the first housing 10 as long as contamination of and damage to the sensors 80 and 82 due to the tubular member 2 and foreign substances adsorbed on the tubular member 2 may be prevented.

Meanwhile, the second sensor 82 is directly provided in the second rotary shaft member 32 of the second roller 30 or provided in a shaft connected to the second rotary shaft member 32 by means of a gear so as to detect the rotational angle and direction of the second roller 30.

Of course, the second sensor 82 is not particularly limited as long as the second sensor 82 may directly or indirectly detect the position of the second roller 30, and all widely known sensors and structures for directly or indirectly detecting the position of the second roller 30 may be applied to the second sensor 82.

Hereinafter, a process of measuring the movement amount of the tubular member 2 and controlling the actuator 50 by the sensors 80 and 82 and the controller 70 according to the first embodiment of the present disclosure will be described in more detail.

Referring to FIGS. 5 and 6, the rotational angle and direction of the first roller 20 is indirectly measured by measuring the rotational angle and direction of the motor rotary shaft 52 by the first sensor 80. The rotational angle and direction of the second roller 30 is indirectly measured by measuring the rotational angle and direction of the magnetic body 38 by the second sensor 82.

In more detail, the movement amount of the tubular member 2 may be indirectly measured by measuring a movement distance of one point on the outer circumferential surface of the first roller 20 according to the rotation of the first roller 20. That is, an arc length L1 calculated by multiplying a rotational angle θ1 of the first roller 20 and a radius R1 of the first roller 20 is the movement amount of the tubular member 2 moved by the first roller 20. Hereinafter, the movement amount of the tubular member 2, which is measured in the above method, is referred to as a first measurement movement amount.

According to the first embodiment of the present disclosure, the first sensor 80 may measure the rotational direction and angle of the first roller 20, and the first sensor 80 or the controller 70 that receives the information from the first sensor 80 may calculate the first measurement movement amount of the tubular member 2, thereby accurately controlling the movement amount d of the tubular member 2.

For example, the controller 70 may control the actuator 50 to rotate the first roller 20 so that the first measurement movement amount is the same as a target movement amount of the tubular member 2, thereby accurately controlling the movement amount d of the tubular member 2.

Meanwhile, a slip may occur between the outer circumferential surface of the first roller 20 and the outer circumference of the tubular member 2. The slip means that a relative movement occurs between the outer circumferential surface of the first roller 20 and the tubular member 2 due to a kinetic friction force acting between the outer circumferential surface of the first roller 20 and the outer circumference of the tubular member 2. When the slip occurs, a difference occurs between the actual movement amount d of the tubular member 2 and the first measurement movement amount.

In order to compensate for this, the controller 70 may calculate the movement amount of the tubular member 2 using the rotational angle and direction of the second roller 30, control the actuator 50 by using the movement amount of the tubular member 2 calculated through the second roller 30 and the first measurement movement amount together, and thus more accurately control the movement amount d of the tubular member 2.

Since the second roller 30 is a driven roller that rotates by the frictional force generated between the outer circumferential surface of the second roller 30 and the outer circumference of the tubular member 2, no slip occurs between the outer circumferential surface of the second roller 30 and the outer circumference of the tubular member 2 or a slip less than a slip between the outer circumferential surface of the first roller 20 and the outer circumference of the tubular member 2 occurs.

That is, the slip occurring in the tubular member 2 may be estimated using the second roller 30 having no or less slip together, the actuator 50 may be controlled using the estimated slip, and thus the movement amount d of the tubular member 2 can be more accurately controlled.

In more detail, the movement amount of the tubular member 2 may be indirectly measured by measuring a movement distance of one point on the outer circumferential surface of the second roller 30 according to the rotation of the second roller 30. That is, an arc length L2 calculated by multiplying a rotational angle θ2 of the second roller 30 and a radius R2 of the second roller 30 is the movement amount of the tubular member 2. Hereinafter, the movement amount of the tubular member 2, which is measured in the above method, is referred to as a second measurement movement amount.

In this case, the controller 70 may control the actuator 50 using the first measurement movement amount and the second measurement movement amount together. For example, the controller 70 may primarily control the actuator 50 to rotate the first roller 20 so that the first measurement movement amount is the same as the target movement amount of the tubular member 2, may then secondarily control the actuator 50 to rotate the first roller 20 so that the second measurement movement amount is the same as the target movement amount of the tubular member 2, and thus may move the tubular member 2.

Through this control method, the amounts of slips occurring between the tubular member 2 and the rollers 20 and 30 are estimated, the estimated amounts of slips are reflected on the control of the actuator 50, and thus the movement amount of the tubular member 2 can be controlled more accurately.

Of course, the controller 70 may primarily control the actuator 50 to rotate the first roller 20 so that the first measurement movement amount is the same as the target movement amount of the tubular member 2, and may secondarily control the actuator 50 to rotate the first roller 20 so that an average value of the first measurement movement amount and the second measurement movement amount is the same as the target movement amount of the tubular member 2.

In this way, in the moving device 1 according to the first embodiment of the present disclosure, the controller 70 may control the movement amount of the tubular member 2 using the first measurement movement amount and the second measurement movement amount together, and thus more accurately control the actual movement amount of the tubular member 2. Of course, in another embodiment, the controller 70 may be configured to control the actuator 50 using only the second measurement movement amount measured by the second sensor 82.

Hereinafter, a moving device according to a second embodiment of the present disclosure will be described. The moving device according to the second embodiment of the present disclosure may have the same configuration as the moving device according to the first embodiment of the present disclosure except for the roller operation unit and the first housing. Thus, a detailed description thereof will be omitted, and the first housing and the roller operation unit according to the second embodiment of the present disclosure will be described in detail.

Figure 7:
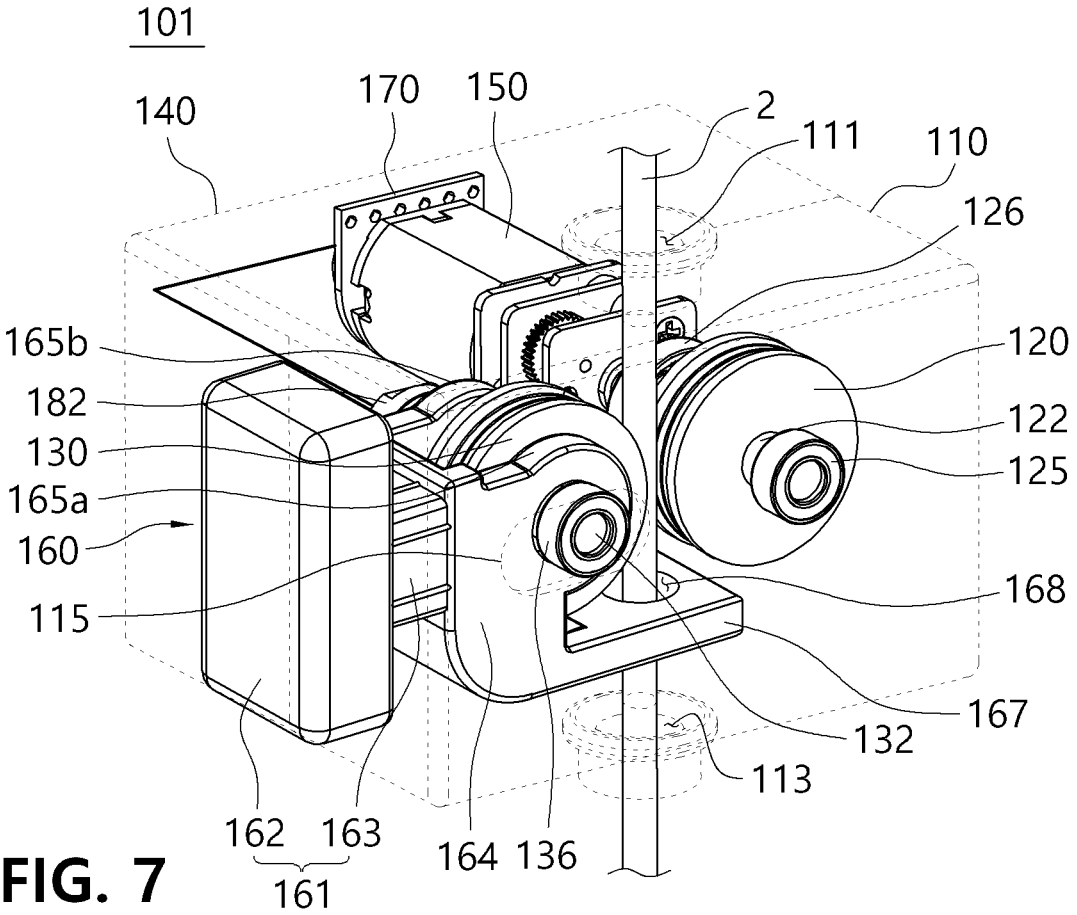
FIG. 7 is a perspective view of a moving device according to a second embodiment of the present disclosure. For description of the present disclosure, first and second housings are indicated by dotted lines, and configurations seen through the first and second housings are indicated by solid lines.
Figure 8:
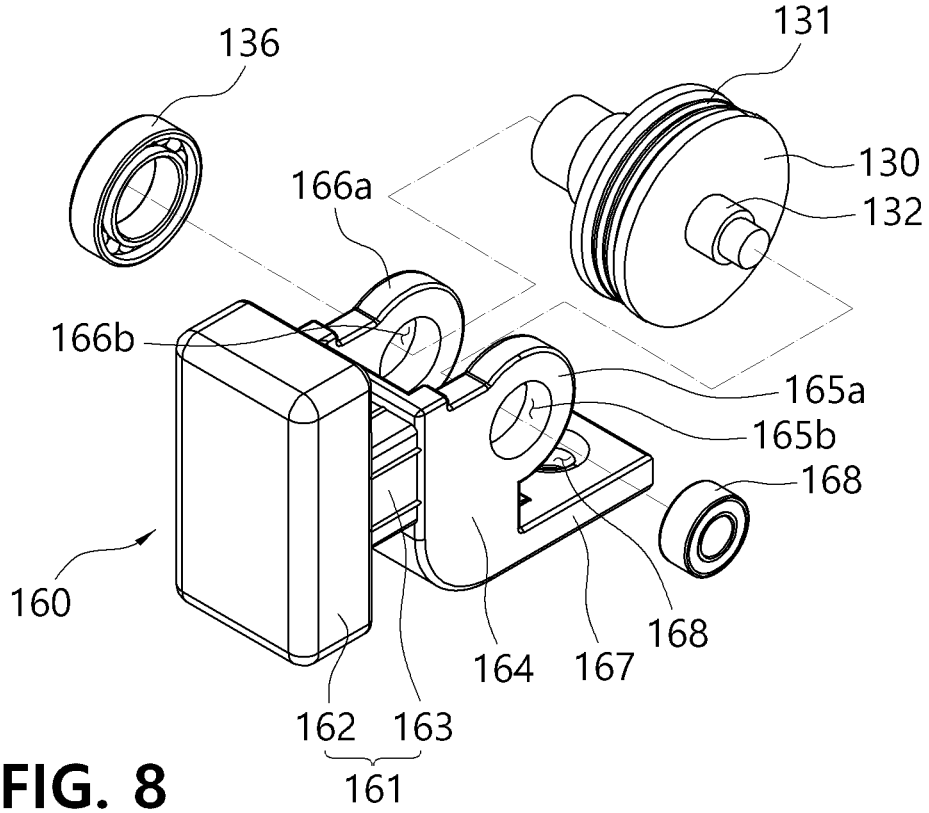
FIG. 8 is an exploded perspective view of the second roller and a roller operation unit of the moving device according to the second embodiment of the present disclosure.
Figure 9:
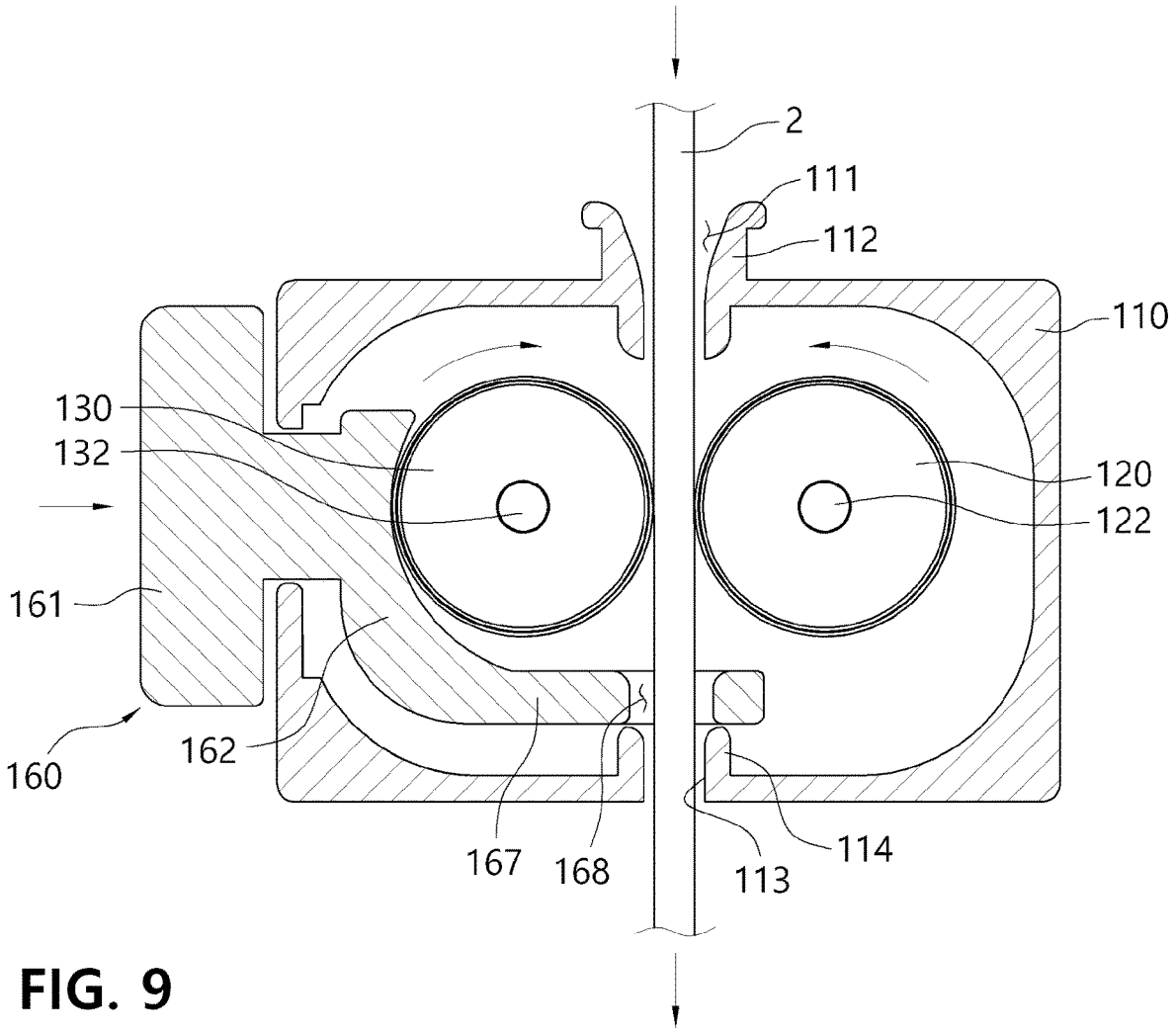
FIGS. 9 and 10 are views for describing an operation of the roller operation unit of the moving device according to the second embodiment of the present disclosure.
Figure 10:
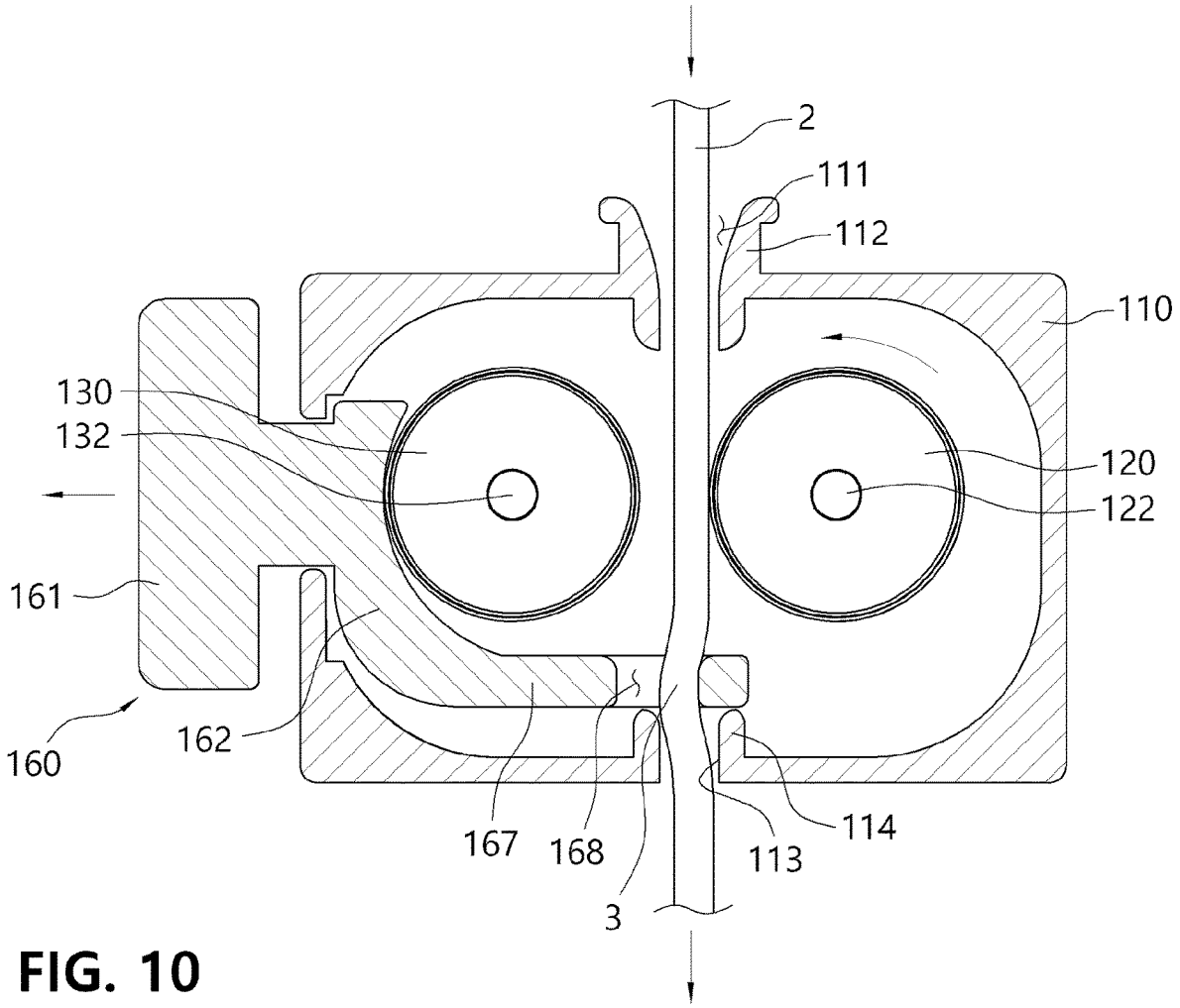

FIG. 7 is a perspective view of a moving device according to the second embodiment of the present disclosure. For description of the present disclosure, first and second housings are indicated by dotted lines, and configurations seen through the first and second housings are indicated by solid lines. FIG. 8 is an exploded perspective view of the second roller and a roller operation unit of the moving device according to the second embodiment of the present disclosure. FIGS. 9 and 10 are views for describing an operation of the roller operation unit of the moving device according to the second embodiment of the present disclosure.

Referring to FIG. 7, a first housing 110 of a moving device 101 according to the second embodiment of the present disclosure is provided with guide holes 115 into which both ends of a second rotary shaft member 132 are inserted. Accordingly, the second rotary shaft member 132 and a second roller 130 may move along the guide hole 115 in a left-right direction.

Referring to FIGS. 7 and 8, the moving device 101 according to the second embodiment further includes a roller operation unit 160. The roller operation unit 160 includes an operation member 164 movably provided in the first housing 110 and coupled to the second rotary shaft member 132, a driving member for moving the operation member 164, and a shutter member 167 that opens or closes an inlet 111 or outlet 113 of the first housing 110.

In the present embodiment, the driving member includes a button member 161 that may be pressed into the first housing 110. The button member 161 includes a head portion 162 that may be pressed and a body portion 163 extending from the head portion 162 toward an inside of the first housing 110 and passing through a side wall of the first housing 110. The body portion 163 may slide through a through-hole of the first housing 110 and may be inserted into or extracted from the inside of the first housing 110.

Referring to FIG. 8, the operation member 164 is formed on one side of the body portion 163. A pair of coupling portions 165*a* and 165*b* protruding while covering both sides of the second roller 130 are provided on one side of the operation member 164. Coupling holes 166*a* and 166*b* are formed in the coupling portions 165*a* and 165*b* in an axial direction of the second rotary shaft member 132.

One end of the second rotary shaft member 132 and a third bearing member 135 are installed at the coupling hole 166*a* of the front coupling portion 165*a*, and the other end of the second rotary shaft member 132 and a fourth bearing member 136 are installed at the coupling hole 166*b* of the rear coupling portion 165*b*. Accordingly, the second rotary shaft member 132 and the second roller 130 may rotate relative to the roller operation unit 160 and linearly move together with the roller operation unit 160.

Referring to FIG. 9, as the button member 161 is pressed into the first housing 110, the operation member 164, the second rotary shaft member 132, and the second roller 130 move in a rightward direction, and the second roller 130 is positioned at a first position adjacent to the first roller 120.

In a state in which the second roller 130 is positioned at the first position, both sides of the tubular member 2 are pressed by the first and second rollers 120 and 130 so that a normal drag force is generated. Accordingly, when the first roller 120 rotates by a frictional force, the tubular member 2 moves while being inserted into the first housing 110 or extracted to the outside.

That is, a driving force of an actuator 150 is transmitted through the first rotary shaft member 122 and the first roller 120 to move the tubular member 2. Hereinafter, a state in which the tubular member 2 may automatically move by the actuator 150 is referred to as an automatic mode.

Referring to FIG. 10, as the button member 161 is extracted to the outside of the first housing 110, the operation member 164 and the second rotary shaft member 132 and the second roller 130 that linearly move integrally with the operation member 164 move in a leftward direction, and thus the second roller 130 is positioned at a second position farther from the first roller 120 than the first position.

In a state in which the second roller 130 is positioned at the second position, a left portion of the tubular member 2 is not pressed by the second roller 130, and thus a normal drag force that generates a frictional force between the first roller 120 and the tubular member 2 cannot be applied to the tubular member 2.

Accordingly, even when the first roller 120 rotates, the driving force of the actuator 150 cannot move the tubular member 2. That is, a user may manually move the tubular member 2. Hereinafter, a state in which the user may manually move the tubular member 2 is referred to as a manual mode.

As described above, in the moving device 101 according to the second embodiment of the present disclosure, the roller operation unit 160 moves the second roller 130 to the first position adjacent to the first roller 120 or moves the second roller 130 to the second position that is farther from the first roller 120 than the first position. Thus, switching from the automatic mode in which the tubular member 2 may be automatically inserted or extracted to the manual mode in which the user directly inserts or extracts the tubular member 2 may be easily achieved or switching from the manual mode to the automatic mode may be easily achieved.

Meanwhile, in the present embodiment, the driving member for moving the operation member 164 is configured as the button member 161 moved by an external force, but the driving member may include a gear and a motor to automatically move the operation member 164.

Meanwhile, referring to FIGS. 7 and 8, a shutter member 167 of the moving device 101 according to the second embodiment of the present disclosure serves as a member that opens or closes the outlet 113 of the first housing 110. The shutter member 167 extends downward from one side, that is, a lower side with respect to FIG. 8, of the operation member 164 and then extends toward the outlet 113. The shutter member 167 may cover a significant portion of a lower surface of the inner wall of the first housing 110 to open or close the outlet 113. In this case, a shutter hole 168 is formed in the shutter member 167.

Referring to FIG. 9, the shutter hole 168 and the outlet 133 are positioned at positions corresponding to each other so that the shutter hole 168 of the shutter member 167 and the outlet 133 may communicate with each other in a state in which the button member 161 is pressed into the first housing 110. In this case, the shutter hole 168 may have a diameter slightly greater than a diameter of the tubular member 2 so that the tubular member 2 may easily pass therethrough. In this case, the tubular member 2 may be inserted into the first housing 110 or extracted to the outside through the shutter hole 168 and the outlet 113.

Referring to FIG. 10, in a state in which the button member 161 is extracted toward the outside of the first housing 110, the shutter hole 168 of the shutter member 167 slightly moves to the left side. Accordingly, the shutter member 167 covers and closes at least a portion of the outlet 113.

As the shutter member 167 moves to the left side while the tubular member 2 passes through the shutter hole 168, an inner circumferential surface of the shutter hole 168 presses the tubular member 2 to the left side. When the tubular member 2 is slightly flexible, a portion 3 of the tubular member 2 positioned inside the shutter hole 168 is slightly bent.

In this way, as the shutter member 167 pushes the tubular member 2 to one side, the tubular member 2 passing through the first housing 110 may be further spaced apart from the first roller 120, and thus the outer circumferential surface of the first roller 120 and the outer circumference of the tubular member 2 are not in contact with each other. Thus, since the driving force of the actuator 150 cannot be transmitted to the tubular member 2 through the first roller 120, switching from the automatic mode to the manual mode can be more completely achieved.

Hereinafter, a moving device according to a third embodiment of the present disclosure will be described. The moving device according to the third embodiment of the present disclosure may have the same configuration as the moving device according to the first embodiment of the present disclosure except for first and second gears. Thus, a detailed description thereof will be omitted, and the first and second gears according to the third embodiment of the present disclosure will be described in detail.

Figure 11:
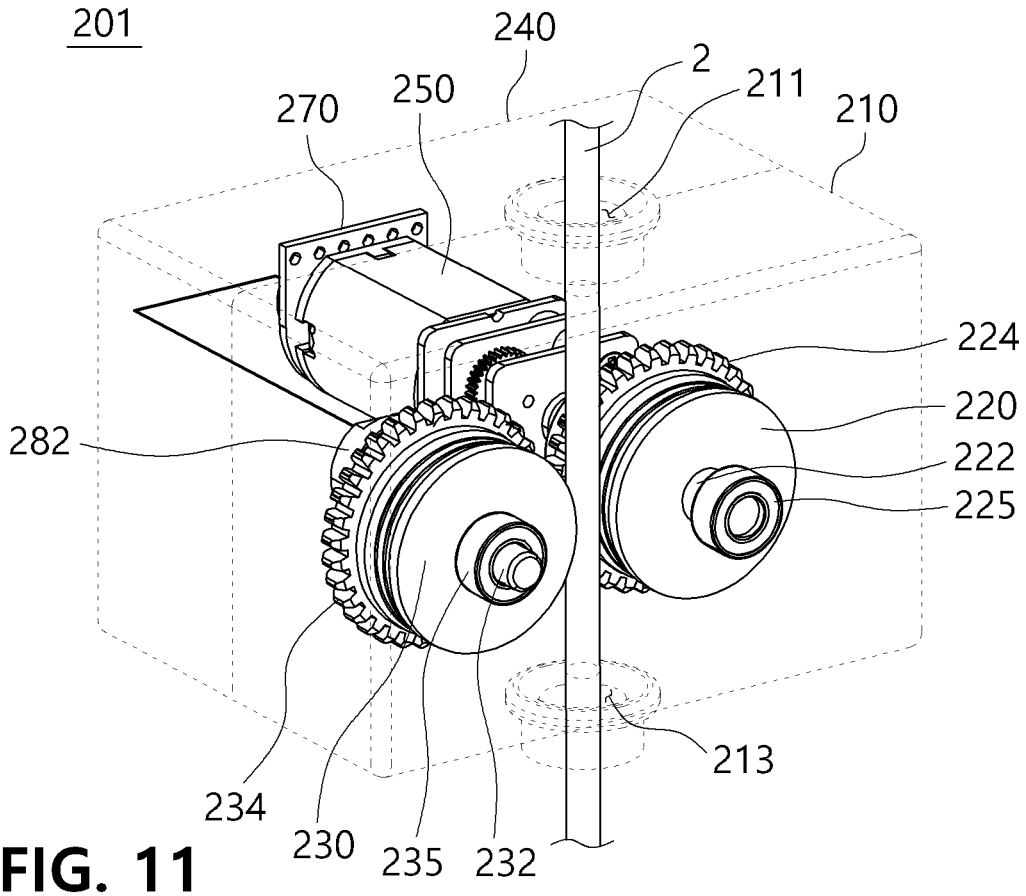
FIG. 11 is a perspective view of a moving device according to a third embodiment of the present disclosure. For description of the present disclosure, first and second housings are indicated by dotted lines, and configurations seen through the first and second housings are indicated by solid lines.

FIG. 11 is a perspective view of a moving device according to the third embodiment of the present disclosure. For description of the present disclosure, first and second housings are indicated by dotted lines, and configurations seen through the first and second housings are indicated by solid lines.

Referring to FIG. 11, a moving device 201 according to the third embodiment of the present disclosure may further include first and second gears 224 and 234 engaged with each other. In this case, the first gear 224 is fixedly installed in a first rotary shaft member 222 so that the first gear 224 may rotate integrally with the first rotary shaft member 222, and the second gear 234 is fixedly installed in a second rotary shaft member 232 so that the second gear 234 may rotate integrally with the second rotary shaft member 232.

Accordingly, a portion of a driving force generated by an actuator 250 and transmitted to the first rotary shaft member 222 is used to rotate a first roller 220, and the other portion thereof is used to rotate the second rotary shaft member 232 and a second roller 230 through the first gear 224 and the second gear 234.

In this case, a gear ratio of the first gear 224 and the second gear 234, a radius of the first roller 220, and a radius of the second roller 230 may be appropriately adjusted so that the first measurement movement amount and the second measurement movement amount are the same.

In this way, in the moving device 201 according to the third embodiment of the present disclosure, a driving force of an actuator 250 is distributed to the first roller 220 and the second roller 230 using the first and second gears 224 and 234, both sides of the tubular member 2 may move together, and thus a slip occurring between the first and second rollers 220 and 230 and the tubular member 2 can be effectively suppressed.

Hereinafter, a moving device according to a fourth embodiment of the present disclosure will be described. The moving device according to the fourth embodiment of the present disclosure may have the same configuration as the moving device according to the third embodiment of the present disclosure except for the roller operation unit. Thus, a detailed description thereof will be omitted, and the roller operation unit according to the fourth embodiment of the present disclosure will be described in detail.

Figure 12:
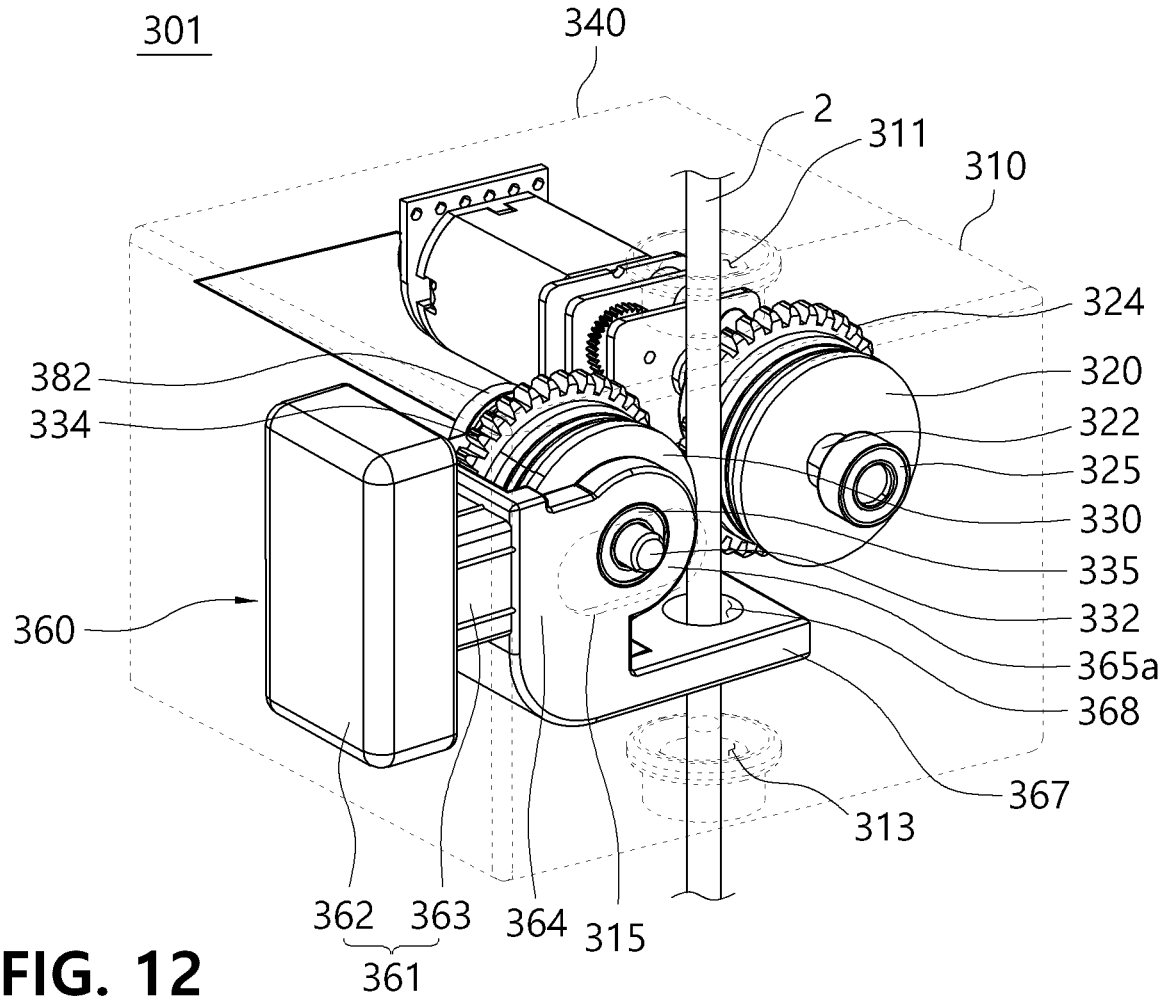
FIG. 12 is a perspective view of a moving device according to a fourth embodiment of the present disclosure. For description of the present disclosure, first and second housings are indicated by dotted lines, and configurations seen through the first and second housings are indicated by solid lines.

FIG. 12 is a perspective view of a moving device according to a fourth embodiment of the present disclosure. For description of the present disclosure, first and second housings are indicated by dotted lines, and configurations seen through the first and second housings are indicated by solid lines.

Referring to FIG. 12, a moving device 301 according to the fourth embodiment of the present disclosure may further include a roller operation unit 360. In this case, the roller operation unit 360 may be the same as the roller operation unit of the moving device according to the second embodiment of the present disclosure.

That, in the moving device 301 according to the fourth embodiment of the present disclosure, a first housing 310 is provided with guide holes 315 into which both ends of a second rotary shaft member 332 are inserted. Accordingly, the second rotary shaft member 332 and a second roller 330 may move along the guide hole 315 in a left-right direction.

The roller operation unit 360 may include a button member 361, an operation member 364, and a shutter member 367. As one side of the button member 361 is pressed, the button member 361 and the operation member 364 are moved to the inside of the first housing 310, and thus the second rotary shaft member 332 and the second roller 330 are moved from the second position to the first position. When the second roller 330 is positioned at the first position, both sides of the tubular member 2 are pressed by first and second rollers 320 and 330, and thus the tubular member 2 is moved by a frictional force generated as the first roller 320 rotates (automatic mode).

In a state in which the second roller 330 is positioned at the second position, the tubular member 2 is not pressed by the second roller 330, and thus no normal drag force is generated in the tubular member 2. Therefore, no driving force of an actuator 350 may be transmitted to the tubular member 2 through the first roller 320 (manual mode). In this case, the user may adjust the movement of the tubular member 2 by hand.

In this way, in the moving device 301 according to the fourth embodiment of the present disclosure, the roller operation unit 360 may move the second roller 330 to the first position and the second position. Thus, switching from the automatic mode in which the tubular member 2 may be automatically inserted or extracted to the manual mode in which the user directly inserts or extracts the tubular member 2 may be easily achieved or switching from the manual mode to the automatic mode may be easily achieved.

Further, in the moving device 301 according to the fourth embodiment of the present disclosure, since first and second gears 324 and 334 are provided in first and second rotary shaft members 322 and 332, a slip occurring between the first and second rollers 320 and 330 and the tubular member 2 can be effectively suppressed.

Hereinafter, a modification of the first and second rollers of the moving device according to an embodiment of the present disclosure will be described.

FIGS. 13 to 16 are views for describing a modification of the first and second rollers of the moving device according to an embodiment of the present disclosure.

Figure 13:
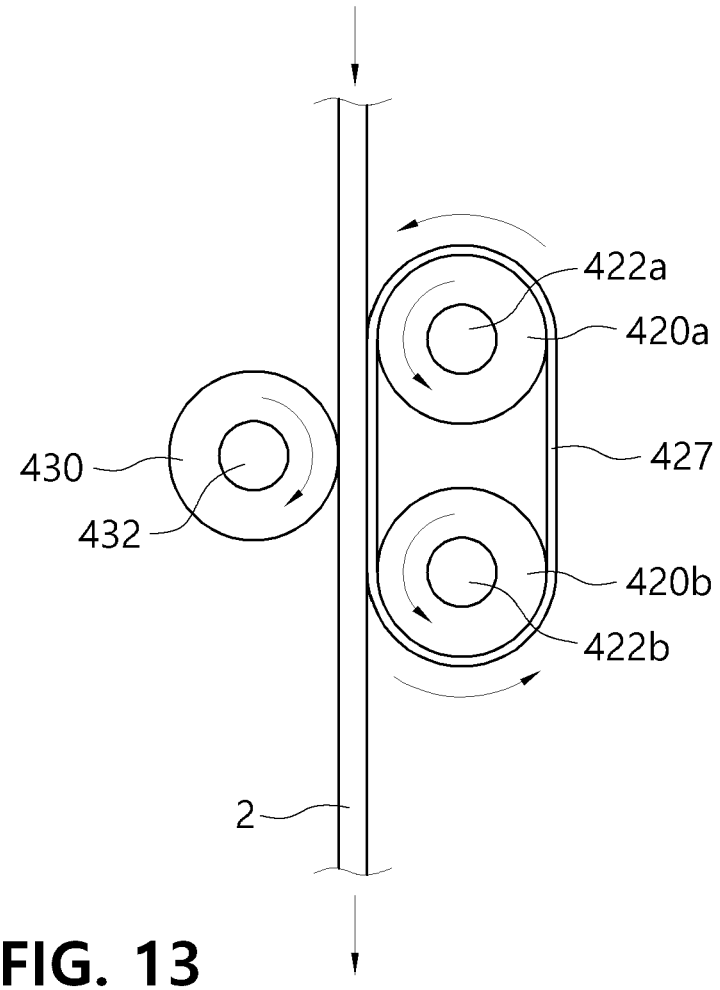
FIGS. 13 to 16 are views for describing a modification of the first and second rollers of the moving device according to an embodiment of the present disclosure.

Referring to FIG. 13, in the modification of the present disclosure, first rollers 420*a* and 420*b* may include a first upper roller 420*a* and a first lower roller 420*b*, and the first upper roller 420*a* and the first lower roller 420*b* are arranged side by side on in a longitudinal direction on one side of the tubular member 2. In this case, a belt 427 is provided on an outer circumferential surface of the first upper roller 420*a* and an outer circumferential surface of the first lower roller 420*b*.

A second roller 430 is disposed to face the other side of the tubular member 2 to press the tubular member 2 toward the belt 427. Of course, the above-described roller operation unit is provided in the second roller 430, the switching between the manual mode and the automatic mode may be achieved, and a pressure with which the second roller 430 presses the other side of the tubular member 2 may be adjusted.

When the first upper roller 420*a* and the first lower roller 420*b* are synchronized to rotate at the same tangential speed, the tubular member 2 is moved by a frictional force generated between the belt 427 and the tubular member 2.

In this case, the synchronization between the first upper roller 420*a* and the first lower roller 420*b* is electronically controlled, which may be achieved by the power transmission member including a plurality of gears coupled to a plurality of motors or one motor coupled to the first upper roller 420*a* and the first lower roller 420*b*.

In this way, according to the first and second rollers 420*a*, 420*b*, and 430 according to the modification of the present disclosure, since a contact area in which the frictional force may be transmitted to the tubular member 2 by the belt 427 increases, the frictional force (or gripping force) applied to the tubular member 2 may increase, so that the tubular member 2 can more stably and efficiently move.

Figure 14:
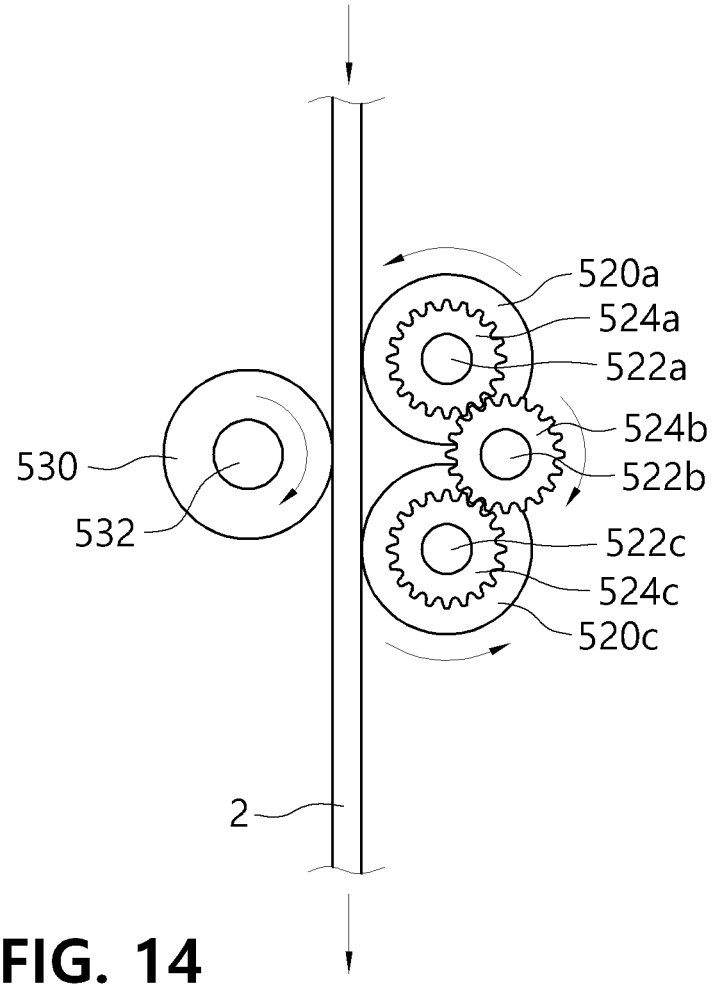

Referring to FIG. 14, in another modification of the present disclosure, first rollers 520*a* and 520*b* may include a first upper roller 520*a* and a first lower roller 520*c*, a first upper gear 524*a* is provided in a first upper rotary shaft member 522*a*, and a first lower gear 524*c* is provided in a first lower rotary shaft member 522*c*.

The first upper roller 520*a* and the first lower roller 520*c* are arranged side by side in the longitudinal direction on the one side of the tubular member 2, and a second roller 530 is disposed to face the other side of the tubular member 2 to press the tubular member 2 toward the first rollers 520*a* and 520*c*. Of course, the above-described roller operation unit is provided in the second roller 530, the switching between the manual mode and the automatic mode may be achieved, and a pressure with which the second roller 530 presses the other side of the tubular member 2 may be adjusted.

In this case, a third rotary shaft member 522*b* that rotates by receiving the driving force from the actuator and a third gear 524*b* provided in the third rotary shaft member 522*b* may be arranged between the first upper roller 520*a* and the first lower roller 520*c*. One side of the third gear 524*b* is engaged with the first upper gear 524*a* and the other side thereof is engaged with the first lower gear 524*c*.

When the third rotary shaft member 522*b* rotates in one direction by the actuator, the first rollers 520*a* and 520*c* receive power through the gears 524*a*, 524*b*, and 524*c* and rotate synchronously in the same direction and speed. Accordingly, the tubular member 2 moves by a frictional force generated between the first rollers 520*a* and 520*c* and the tubular member 2. In this case, the synchronization between the first upper roller 520*a* and the first lower roller 520*c* may be achieved by the power transmission member including a plurality of gears engaged with the actuator.

In this way, in the first and second rollers according to another modification of the present disclosure, the number of first rollers 520*a* and 520*c* in contact with the tubular member 2 increases, the frictional force (or gripping force) applied to the tubular member 2 increases, and thus the tubular member 2 can stably and efficiently move, and the movement amount of the tubular member 2 can be precisely measured using the second roller 530.

Of course, through a structural modification of the actuator or the power transmission member, the number of the first and second rollers 520*a*, 520*c*, and 530 increases, and thus the frictional force (or the gripping force) applied to the tubular member 2 can further increase.

Figure 15:
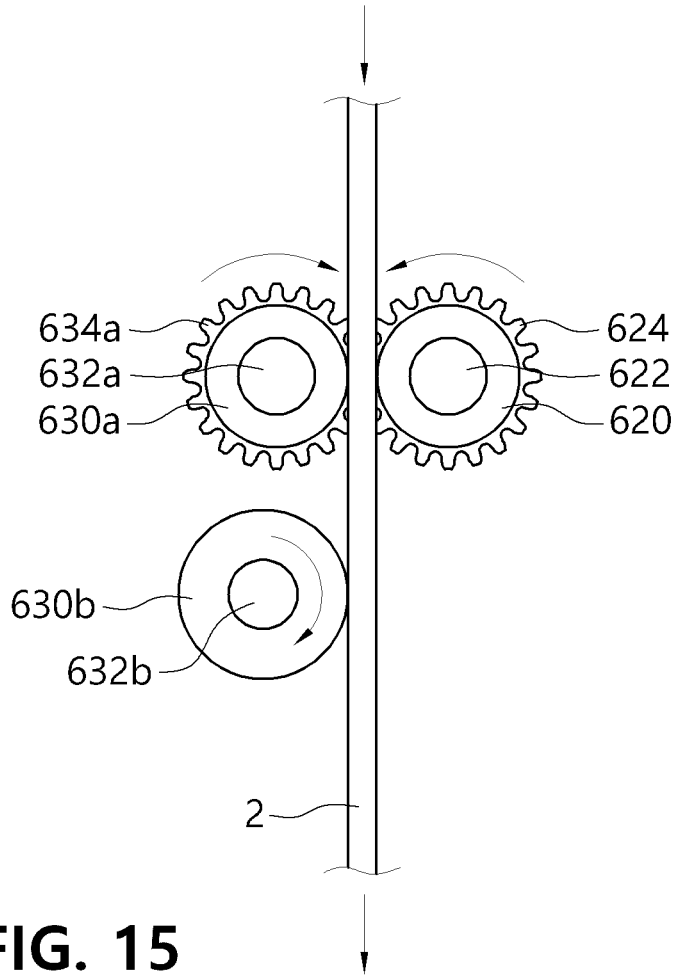

Referring to FIG. 15, according to still another modification of the present disclosure, second rollers 630*a* and 630*b* may include a second upper roller 630*a* and a second lower roller 630*b* arranged side by side in the longitudinal direction of the tubular member 2.

A first gear 624 is provided in a first rotary shaft member 622, and a second gear 634*a* is provided in a second upper roller rotary shaft member 632*a*. The first gear 624 and the second gear 634*a* are engaged with each other.

Accordingly, a portion of the driving force generated by the actuator and transmitted to the first rotary shaft member 622 is used to rotate a first roller 620, and the other portion thereof is used to rotate the second upper roller rotary shaft member 632*a* and the second upper roller 630*a* through the first gear 624 and the second gear 634*a*.

In this way, in the moving device according to yet another modification of the present disclosure, the driving force of the actuator is distributed to the first roller 620 and the second upper roller 630*a* using the first and second gears 624 and 634*a*, both sides of the tubular member 2 may move together, and thus a slip occurring between the first roller 620 and the second upper roller 630*a* and the tubular member 2 can be effectively suppressed.

Further, since the second lower roller 630*b* assists the second upper roller 630*a* on a lower side of the second upper roller 630*a* to press the tubular member 2 toward the first roller 620, the frictional force (or gripping force) applied to the tubular member 2 may increase, and thus the tubular member 2 can more stably and efficiently move.

Of course, the above-described roller operation unit is provided in the second rollers 630*a* and 630*b*, the switching between the manual mode and the automatic mode may be achieved, and a pressure with which the second rollers 630*a* and 630*b* press the other side of the tubular member 2 may be adjusted.

Figure 16:
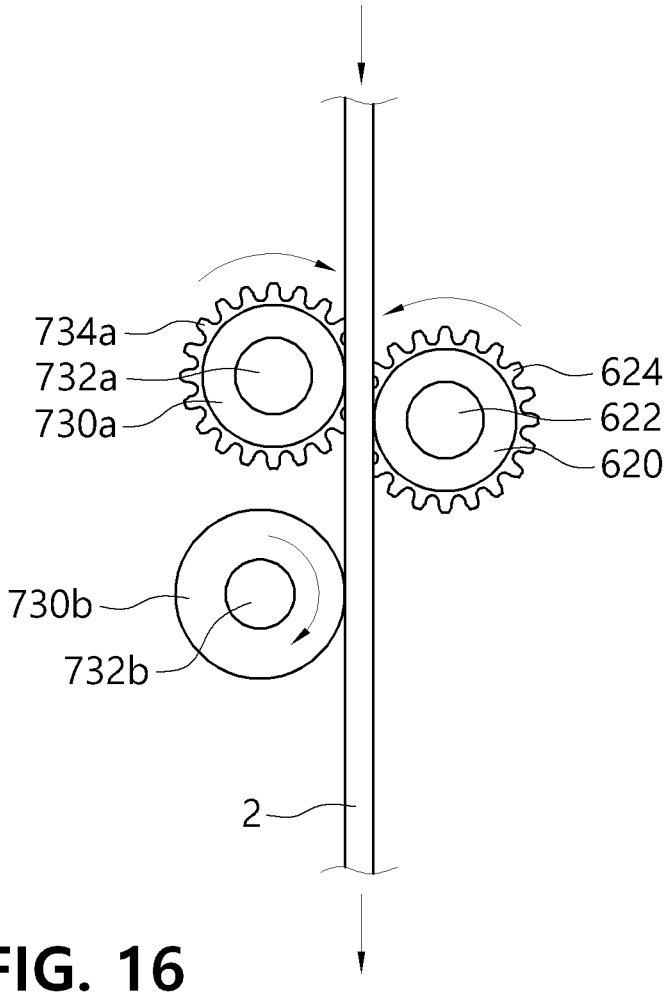

Referring to FIG. 16, in yet another modification of the present disclosure described with reference to FIG. 15, positions of second rollers 730*a* and 730*b* may be modified. In the present modification, the second upper roller 730*a* is positioned slightly higher than the first roller 630, and the second lower roller 730*b* is positioned slightly lower than the first roller 630.

In this way, since the first and second rollers 620, 730*a*, and 730*b* may more stably press both sides of the tubular member 2 by adjusting the positions of the first and second rollers 620, 730*a*, and 730*b*, the tubular member 2 can more stably and efficiently move.

Of course, the first gear 624 of the first roller 620 and a second gear 734*a* of the second upper roller 730*a* may be slightly modified so that the second upper roller 730*a* may be positioned further upward.

As described above, in the moving device according to the embodiment of the present disclosure, the tubular member may automatically move by using the frictional force between the first roller rotating by the driving force generated by the actuator and the tubular member.

Further, the moving device according to the embodiment of the present disclosure includes a sensor for measuring the movement amount of the tubular member and a controller for controlling the actuator, wherein the controller controls the actuator by using the movement amount of the tubular member, measured by the sensor, and thus can accurately control the movement amount of the tubular member.

Meanwhile, although it has been described that the first and second housings have quadrangular shapes, it is noted that the shape of each component may be variously modified and changed without departing from the technical spirit of the present disclosure, for example, the first and second housings are formed in a curved surface in consideration of a relationship with peripheral devices or are curved in a handle shape for convenience of use.

According to the above configuration, in a moving device according to an embodiment of the present disclosure, first and second rollers having outer circumferential surfaces that may press a tubular member are arranged to face both sides of the tubular member, the tubular member moves by a frictional force as the first roller that receives a driving force from an actuator rotates, and thus the tubular member may automatically move.

Further, in the moving device according to the embodiment of the present disclosure, a sensor and a controller may measure the movement amount of the tubular member, and the controller may control the actuator on the basis of the measured movement amount of the tubular member, thereby accurately controlling the movement amount of the tubular member.

Further, in the moving device according to the embodiment of the present disclosure, a first housing for accommodating an operation unit and a second housing for accommodating a driving unit and an operation control unit are detachably coupled, and thus the operation unit and the driving unit may be separated from each other.

Further, in the moving device according to the embodiment of the present disclosure, a roller operation unit moves the second roller to a first position adjacent to the first roller or moves the second roller to a second position farther away from the first roller than the first position, and thus switching from an automatic mode in which the tubular member may be automatically inserted or extracted to a manual mode in which a user directly inserts or extracts the tubular member may be easily achieved or switching from the manual mode to the automatic mode may be easily achieved.

Logical blocks, modules or units or controllers described in connection with embodiments disclosed herein can be implemented or performed by a computing device having at least one processor, at least one memory and at least one communication interface. The elements of a method, process, or algorithm described in connection with embodiments disclosed herein can be embodied directly in hardware, in a software module executed by at least one processor, or in a combination of the two. Computer-executable instructions for implementing a method, process, or algorithm described in connection with embodiments disclosed herein can be stored in a non-transitory computer readable storage medium.

The effects of the present disclosure are not limited to the above effects and should be understood to include all effects that may be deduced from the detailed description of the present disclosure or the configuration of the present disclosure described in the appended claims.

Although the embodiments of the present disclosure have been described, the spirit of the present disclosure is not limited to the embodiments presented in the present specification. Those skilled in the art who understand the spirit of the present disclosure may easily propose other embodiments by adding, changing, deleting, adding, or the like of components within the same scope of the spirit. Further, these other embodiments also belong to the scope of the spirit of the present disclosure.

What is claimed is:

1. A moving device for moving a tubular member, the moving device comprising:

a housing having a hole through which the tubular member passes;

a first roller and a second roller arranged to face both sides of the tubular member inside the housing and having outer circumferential surfaces configured to press the tubular member;

an actuator configured to provide a driving force for rotating the first roller;

a sensor configured to measure a movement amount of the tubular member;

a controller configured to control the actuator on the basis of the movement amount of the tubular member; and a roller operation unit comprising:

an operation member movably coupled to the housing and having one side coupled to a rotary shaft of the second roller, and a driving member configured to move the operation member, wherein the operation member is moved by the driving member to cause the second roller to move between a first position adjacent to the first roller and a second position farther from the first roller than the first position; and a shutter member positioned adjacent to the hole and coupled to the operation member, the shutter member being configured to open or close at least a portion of the hole, wherein, when the first roller rotates at the first position of the second roller, the tubular member between the first roller and the second roller moves by a frictional force.

2. The moving device of claim 1, wherein the sensor includes a first sensor configured to detect a position of the first roller, and the controller is configured to measure the movement amount of the tubular member using the position of the first roller.

3. The moving device of claim 2, wherein the actuator includes a motor, the first sensor is a first encoder provided in a rotary shaft of the motor, and the controller is configured to measure the movement amount of the tubular member using a position of the rotary shaft, which is detected by the first encoder.

4. The moving device of claim 1, wherein the sensor includes a second sensor configured to detect a position of the second roller, and the controller is configured to measure the movement amount of the tubular member using the position of the second roller.

5. The moving device of claim 4, wherein a magnetic body rotating together with the second roller is provided on one side of the second roller, the sensor includes a second encoder positioned adjacent to the magnetic body to detect a position of the magnetic body, and the controller is configured to measure the movement amount of the tubular member using the position of the magnetic body.

6. The moving device of claim 1, wherein the sensor includes:

a first sensor configured to detect a position of the first roller; and a second sensor configured to detect a position of the second roller, the controller controls the actuator on the basis of a first movement amount of the tubular member, which is measured using the position of the first roller, and a second movement amount of the tubular member, which is measured using the position of the second roller.

7. The moving device of claim 1, wherein the housing includes:

a first housing in which the first roller and the second roller are embedded; and a second housing in which the actuator is embedded, and the first housing and the second housing are detachably coupled to each other.

8. The moving device of claim 7, wherein the controller and the sensor are provided in the second housing.

9. The moving device of claim 1, wherein the first roller is provided as a plurality of first rollers, and the plurality of first rollers are arranged in a longitudinal direction of the tubular member.

10. The moving device of claim 9, wherein the plurality of first rollers include a first upper roller and a first lower roller, a belt having an outer portion in contact with an outer circumference of the tubular member is provided on the outer circumferential surface of the first upper roller and the first lower roller, and when the first roller rotates, the tubular member between the belt and the second roller is moved by the frictional force.

11. The moving device of claim 1, wherein the driving member includes a button member that is pressed into the housing, and as the button member is pressed, the operation member moves.

12. The moving device of claim 1, wherein the housing is provided with a guide member configured to guide movement of the tubular member.

13. The moving device of claim 1, wherein the shutter member has one side coupled to the operation member to be movable integrally with the operation member, the shutter member opens the hole of the housing in a state in which the operation member moves the second roller to the first position, and the shutter member closes the at least a portion of the hole of the housing in a state in which the operation member moves the second roller to the second position.

14. The moving device of claim 1, wherein a first gear configured to receive the driving force from the actuator to rotate integrally with the first roller is provided on one side of the first roller, and a second gear that rotates integrally with the second roller and is engaged with the first gear is provided on one side of the second roller.

15. The moving device of claim 1, further comprising:

a power transmission member configured to transmit the driving force provided from the actuator to the second roller, wherein the power transmission member includes at least two gear members.

16. The moving device of claim 1, wherein grooves corresponding to an outer circumference of the tubular member are formed in the outer circumferential surfaces of the first roller and the second roller.

17. The moving device of claim 1, wherein the second roller is provided as a plurality of second rollers, and the plurality of second rollers are arranged in a longitudinal direction of the tubular member.

* * * * *